US005230286A

United States Patent [19]

Schmitt

[11] Patent Number: 5,230,286

[45] Date of Patent: Jul. 27, 1993

[54] INKING UNIT FOR A PRINTING MACHINE

[75] Inventor: Edwin C. Schmitt, Zell, Fed. Rep. of Germany

[73] Assignee: De La Rue Giori, S.A., Lausanne, Switzerland

[21] Appl. No.: 947,424

[22] Filed: Sep. 18, 1992

[30] Foreign Application Priority Data

Oct. 11, 1991 [CH] Switzerland ..... 2997/91

[51] Int. Cl.[5] ..... B41F 31/00; B41F 9/00

[52] U.S. Cl. ..... 101/363

[58] Field of Search ..... 101/350, 363, 364, 148, 101/207, 208, 209, 210, 157, 169, 153; 118/259, 261

[56] References Cited

U.S. PATENT DOCUMENTS 4,382,660 1/1991 Hamm et al. ..... 101/350
4,991,504 2/1991 Fina ..... 101/208
5,044,277 9/1991 John ..... 101/363

*Primary Examiner*—J. Reed Fisher
*Attorney, Agent, or Firm*—Kane, Dalsimer, Sullivan, Kurucz, Levy, Eisele and Richard

[57] ABSTRACT

The side walls (2) of the ink fountain (1) bear with their front edge on the circumference of the ductor roller (4) solely in the region of the entry face (2*a*) and of the exit face (2*c*), whilst the intermediate middle region (2*b*) forms with the ductor roller (4) a crescent-shaped gap. The maximum width of this gap amounts to between 0.2 and 0.5 mm and is selected in dependence on the viscosity of the ink such that no ink can escape, but a build-up of ink which could press the front edge of the side walls away is prevented from occurring during operation.

5 Claims, 2 Drawing Sheets

INKING UNIT FOR A PRINTING MACHINE

FIELD OF THE INVENTION

The invention relates to an inking unit for a printing machine, especially for receiving high-viscosity ink, having a ductor roller and an ink fountain with side walls, the front edge of which touches the circumference of the ductor roller and forms a radial ink-fountain seal.

PRIOR ART

In hitherto known ink fountains of this type, such as are described by of example in U.S. Pat. No. 4,991,504, the side walls of the ink fountain have a front edge curved in the form of an arc of a circle and with a radius which is equal to the radius of the ductor roller. The side walls thus bear on the circumference of the ductor roller along their entire front edge, and it has hitherto been thought that this complete bearing of the side walls on the ductor roller would be necessary for good radial ink-fountain sealing.

However, the disadvantage of this design of the side walls of the ink fountain is that, even after a short operating time, ink can build up on the sealing face, that is to say between the circumference of the ductor roller and the front edge of the side walls, particularly as a result of the hydrostatic pressure, and that the front edge is thereby pressed away from the circumference of the ductor roller. There is therefore the risk that the ink-fountain sealing will be impaired.

SUMMARY OF THE INVENTION

The object on which the present invention is based is to design an ink fountain for a printing machine in such a way that good radial ink-fountain sealing remains guaranteed even over a long operating time.

This object is achieved in that the front edge of the side walls of the ink fountain bears on the ductor roller solely in the regions of the entry and the exit, whilst the intermediate region of this front edge does not touch the ductor roller and forms with this a gap, the maximum width of which is only of such a size as to prevent an escape of ink.

Thus, only the entry and exit faces of the front edge of the side walls come to bear on the ductor roller, so that a gap is obtained in the middle region of the front edge, thereby preventing an adverse build-up of ink, as a result of which the side walls could be pressed away from the ductor roller. Moreover, for a given pressing force by which the ink fountain is pressed against the ductor roller, a higher pressing force is achieved at the entry and exit, since, of course, only a small region of the front edge of the side walls touches the ductor roller.

The impermeability between side walls and ductor roller is brought about by the viscosity and the gradual drying of the ink in the gap. Depending on the nature, especially the viscosity, of the ink used, the maximum width of the gap can be selected between 0.2 and 0.5 mm. Where an intaglio printing machine is concerned, that is to say when the conventional high-viscosity intaglio printing ink is used, the maximum gap width is preferably selected at approximately 0.4 mm.

The front edge of the side walls appropriately has different radii, so that in the region of the entry and exit the radius is equal to that of the ductor roller, whilst in the intermediate region it is selected smaller. The regions of the entry and exit which bear on the circumference of the ductor roller extend preferably over an angle of 5° to 20°, especially over approximately 15°.

BRIEF DESCRIPTION OF THE DRAWINGS

The invention is explained in more detail by means of an exemplary embodiment with reference to the drawing. In this.

DESCRIPTION OF THE PREFERRED EMBODIMENT

In both figures, the width of the gap between the ductor roller and the middle region of the side walls of the ink fountain is shown exaggerated for the sake of clarity.

Figure 1:
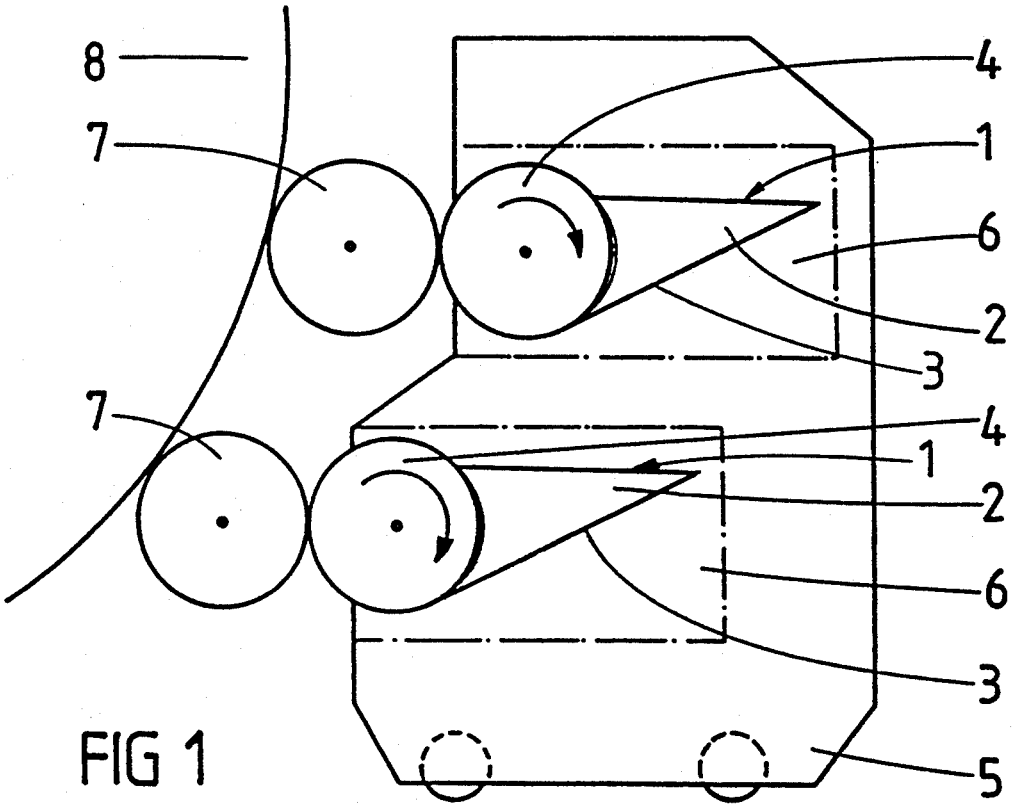
FIG. 1 shows a diagrammatic representation of an inking device having two inking units according to the invention, such as is installed for example in an intaglio printing machine, of which the plate cylinder and the stencil rollers which transfer the ink from the ductor rollers onto the plate cylinder are shown.

The inking device illustrated in FIG. 1 has two inking units arranged one above the other, such as are used for example in intaglio printing machines. This inking device has an inking-unit carriage 5 with two frames 6 which are arranged one above the other and in each of which are installed an ink fountain 1, consisting of a bottom 3 and two side walls 2, and a ductor roller 4. The bottom 3 is formed by a wiper, the front edge of which forms with the circumference of the ductor roller 4 a small adjustable gap which defines the thickness of the ink film transferred onto the ductor roller. To illustrate one use of the inking units, there are shown the stencil rollers 7 which are assigned to these and are inked by the ductor rollers 4 and which transfer ink onto the intaglio printing plates (not shown) of the plate cylinder 8 of an intaglio printing machine.

Figure 2:
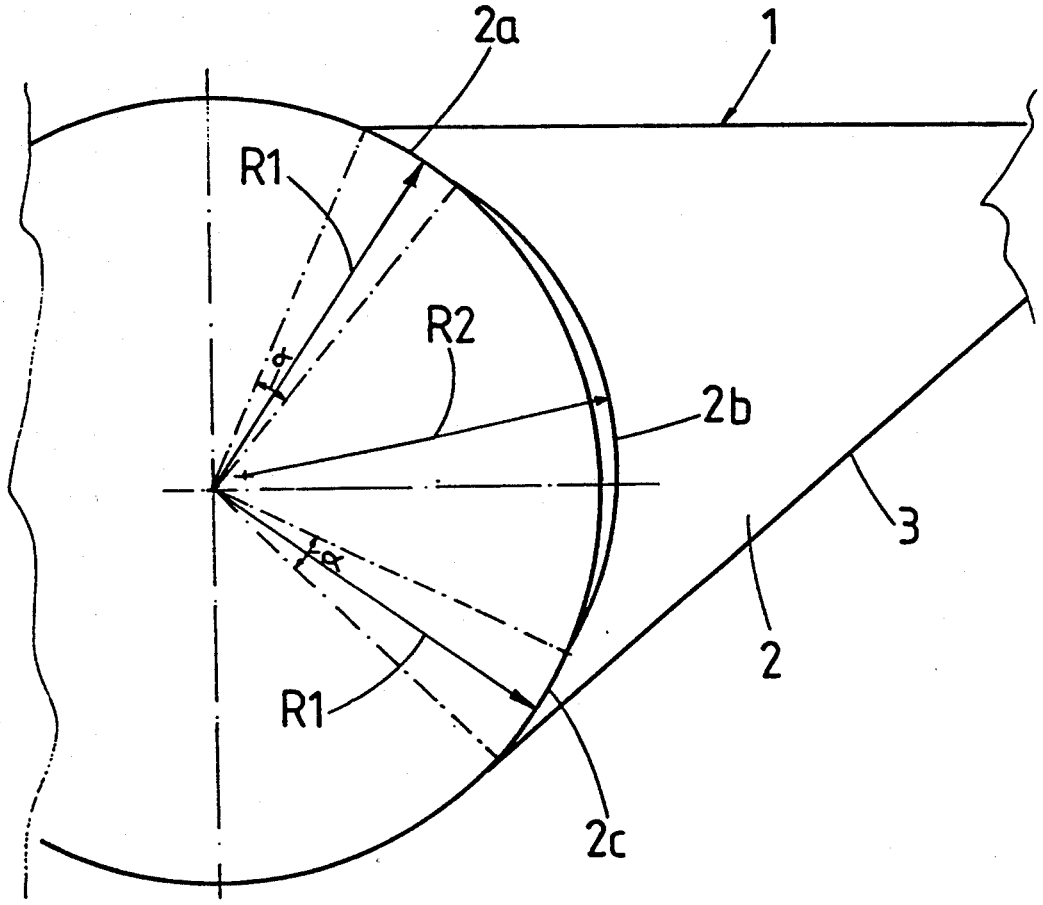
FIG. 2 shows a diagrammatic enlarged representation of an ink fountain.

As illustrated in FIG. 2, the front edge of the side walls 2 of an ink fountain 1 bears on the circumference of the ductor roller 4 solely in the region of the entry **2*a* and of the exit 2*c*, whilst the intermediate region 2*b* of the front edge forms with the ductor roller 4** a narrow crescent-shaped gap, the maximum width of which is selected in dependence on the nature, especially the viscosity of the ink such, that an escape of ink is prevented. It was found that in general, when there is a gap width dependent on the nature of the ink and with maximum values of between 0.2 and approximately 0.5 mm, the viscosity and the gradual drying of the ink guarantee a good seal.

In the region of the entry **2*a* and of the exit 2*c*, the radius R1 of the front edge of the side walls 2 is equal to the radius of the ductor roller 4, so that the entry and exit faces bear flush on the circumference of the ductor roller. The intermediate middle region 2*b*** of the front edge is likewise curved in the form of an arc of a circle, but has a somewhat smaller radius R2. The centers of the circles defined by these radii R1 and R2 naturally do not coincide. In a practical example, R1 can be equal to 135.5 mm and R2 to 140.0 mm.

The regions of the entry **2*a* and of the exit 2*c*** can extend over a respective angle $\alpha$ and $\gamma$ of 5° to 20°, preferably, as in the example under consideration, over approximately 15°. If conventional high-viscosity intaglio printing ink is used, the radius R2 of the middle region 2*b* of the front edge is selected so much smaller than the radius of the ductor roller 4 that the maximum gap width amounts to approximately 0.4 mm.

The side walls of the ink fountain preferably consist of a self-lubricating polyamide plastic, such as is known for example under the brandname Nylatron.

The invention is not restricted to the exemplary embodiment shown, but permits of many alternative versions in respect of the exact form of the side walls of the ink fountain.

I claim:

1. An inking unit for a printing machine, especially for receiving high-viscosity ink, having a ductor roller (4) and an ink fountain (1) with side walls (2), the side walls having a curved edge which touches the circumference of the ductor roller (4) and forms radial ink-fountain seal, wherein the front edge of the side walls (2) of the ink fountain (1) bears on the ductor roller (4) solely in the regions of the entry (2*a*) and of the exit (2*c*), whilst the intermediate region (2*b*) of this front edge does not touch the ductor roller and forms with this a gap, the maximum width of which is only of such a size as to prevent an escape of ink, said front edge having in the region of the entry (2*a*) and of the exit (2*c*) a radius (R1) which is equal to the radius of the ductor roller (4), whilst the intermediate region (2*b*) of the front edge having a smaller radius (R2).

2. An ink fountain as claimed in claim 1, wherein the maximum width of the gap is 0.2 to 0.5 mm.

3. The ink fountain as claimed in claim 2, for receiving high-viscosity intaglio printing ink, wherein the maximum gap width amounts to approximately 0.4 mm.

4. The ink fountain as claimed in claim 1, wherein the region of the entry (2*a*) and of the exit (2*c*) of said front edge extends over an angle of 5° to 20°.

5. The ink fountain as claimed in claim 4, wherein the angle is approximately 15°.

* * * * *